US007340932B2

(12) United States Patent
Wysocki et al.

(10) Patent No.: US 7,340,932 B2
(45) Date of Patent: Mar. 11, 2008

(54) WIRE-ROLLING APPARATUS

(75) Inventors: Jaroslaw Wysocki, Neuss (DE); Gerhard Herzog, Mülheim a. d. Ruhr (DE); Lutz Kümmel, Jüchen (DE)

(73) Assignee: SMS Meer GmbH, Monchengladbach (DE)

( * ) Notice: Subject to any disclaimer, the term of this patent is extended or adjusted under 35 U.S.C. 154(b) by 8 days.

(21) Appl. No.: 11/501,671

(22) Filed: Aug. 9, 2006

(65) Prior Publication Data

US 2007/0033977 A1 Feb. 15, 2007

(30) Foreign Application Priority Data

Aug. 11, 2005 (DE) ..... 10 2005 038 328
Jul. 20, 2006 (DE) ..... 10 2006 034 094

(51) Int. Cl.
*B21B 27/06* (2006.01)
*B21B 39/20* (2006.01)

(52) U.S. Cl. ..... 72/202; 72/201; 72/250; 72/251

(58) Field of Classification Search ..... 72/201, 72/202, 250, 251; 140/2; 148/595
See application file for complete search history.

(56) References Cited

U.S. PATENT DOCUMENTS 3,056,433 A * 10/1962 Haugwitz ..... 140/2
3,585,887 A * 6/1971 Gerhard et al. ..... 83/18
3,756,289 A * 9/1973 Rotert et al. ..... 140/2
3,759,125 A * 9/1973 Vortkamp ..... 83/90
3,977,224 A * 8/1976 Stubbins ..... 72/201
4,995,251 A * 2/1991 Reumann et al. ..... 72/132
5,568,744 A * 10/1996 Grotepass ..... 72/201

* cited by examiner

*Primary Examiner*—Dmitry Suhol
(74) *Attorney, Agent, or Firm*—Andrew Wilford

(57) ABSTRACT

A rolling-mill cooling unit has a cooling-unit conveyor transporting fanned-out loops of wire in a transport direction toward a coiler spaced downstream from the cooling-unit conveyor and serving to organize the fanned-out loops of wire into coils or bundles. A feeder conveyor extending in the direction has an upstream end juxtaposed with the cooling unit and a downstream end juxtaposed with the coiler and is operable to advance the loops of wire from the unit to the coiler. The entire feeder conveyor can be shifted relative to the coiler and to the cooling unit in the direction so as to displace the upstream and downstream ends relative to the cooling unit and coiler.

10 Claims, 3 Drawing Sheets

WIRE-ROLLING APPARATUS

FIELD OF THE INVENTION

The present invention relates to a wire- or rod-rolling apparatus. More particularly this invention concerns such an apparatus that takes fanned-out loops of wire from a cooling unit and feeds them to a coiling or bundling device.

BACKGROUND OF THE INVENTION

Wire or rod, the former term generally referring to a product of smaller cross-sectional size than the latter, is produced in a rolling mill starting from a relatively massive billet that is typically heated to a high temperature so that it can be plastically deformed. The hot billet is passed through a succession of roll stands that incrementally reduce its cross-sectional size and increase its length, simultaneously imparting good grain structure and ductility to the metal.

At the downstream end of the rolling mill the rolled-out rod or wire is passed, typically after being formed into a multiplicity of fanned-out loops, through a cooling unit. Then the cooled loops are moved by a conveyor to a coil- or bundle-forming device that stacks a predetermined number of the loops up to form annular coils or bundles. The workpiece is cut and the bundles are tied together for transport to the end user. Of course other processes—e.g. galvanizing—can take place upstream.

So as to achieve the appropriate material properties when rolling wire, both thin wire measuring up to about 20 mm in diameter and thick wire or rod measuring up to about 50 mm in diameter are subjected to different cooling processes after exiting the multistand production line of the rolling mill. These processes comprise for thin wire, the so-called Stelmor products, and thick wire, the so-called Garrett products, either standard or forced cooling, for example for medium or high carbon steel and austenite, delayed cooling, for example for low carbon steel, screw steel, spring steel and wrought iron, or slow cooling, for example for tool steel and high-speed steel. These prerequisites can be created by a correspondingly configured cooling section.

U.S. Pat. No. 5,568,744 describes a system of the kind described above for Stelmor cooling of a thin wire, in which wire loops of a wire product that is fanned out on a conveyor are cooled with the help of cooling air and open or closed, or partially open and partially closed, covers or hoods of the cooling section or by means of heat retention pots. The cooling of thick wire wound into coils can be achieved at the ambient air or through fans in the area of the longitudinal transport of the cooling section, by the use of water reels, by adding insulated covers, by means of heat retainers or in insulation chambers. This way it is possible to carry out cooling that meets the requirements of the product, above all when a wide range of properties is desired, as is the case particularly for stainless-steel products.

Downstream of the wire-rolling mill of this known system, a coiler is provided following the cooling unit, in which coiling device the wire loops are removed from a feeder conveyor that is provided as a bridge element between the furthest downstream conveying section of the cooling unit and the coiler. The wire coils formed this way are removed, for example fed to a ring pressing and coiling station with a hook conveyor, and distributed further from there.

The feeder conveyors known in practice are made up of arrays or tables formed by rollers at least some of which are driven, conveyor belts or conveyor chains. These feeder conveyors are anchored to the floor in a stationary manner.

In the transition region to the coiler, they are associated with a split roller segment that is a separate component and reaches partially around the coiler and comprises pairs of spaced split rollers. The split roller segment is adjustable in different directions of movement and so are the split rollers. This is supposed to enable a more specific placement of the wire loops in the coiler. The split rollers, which are not single-piece continuous rollers, but instead aligned and spaced pairs of short roller, take care of this. Both rollers of each pair of opposing split rollers has the same short length, and these short lengths become shorter from roller pair to roller pair towards the coiler, that is downstream.

It has been shown during operation that with the known systems the transfer of the wire loops from the cooling unit into the feeder conveyor and from there to the split roller segment that is provided on one side and provided directly upstream of the coiler, is problematic. This is due to the fact that gaps are unavoidable between these components, which gaps negatively influence the structure of the wire loops closely following and overlapping each other, which impairs the feeding and/or placement into the coiler.

OBJECTS OF THE INVENTION

It is therefore an object of the present invention to provide an improved wire- or rod-rolling apparatus.

Another object is the provision of such an improved wire- or rod-rolling apparatus that overcomes the above-given disadvantages, in particular that allows unimpaired transport with reliable conveyance of the wire loops from one transport section to another and that improves the placement of the wire loops into the coiler.

SUMMARY OF THE INVENTION

A rolling-mill cooling unit has a cooling-unit conveyor transporting fanned-out loops of wire in a transport direction toward a coiler spaced downstream from the cooling-unit conveyor and serving to organize the fanned-out loops of wire into coils or bundles. According to the invention a feeder conveyor extending in the direction has an upstream end juxtaposed with the cooling unit and a downstream end juxtaposed with the coiler and is operable to advance the loops of wire from the unit to the coiler. Means is provided for shifting the entire feeder conveyor relative to the coiler and to the cooling unit in the direction so as to displace the upstream and downstream ends relative to the cooling unit and coiler.

Thus this object is achieved according to the invention in that the entire feeder conveyor is configured in a linear displaceable fashion. Since the feeder conveyor is preferably displaceable in and against the transport direction, the conveyor can always be specifically positioned such that no gaps occur between the individual transport sections, so that the fanning of the wire loops is not distorted and they can be placed in the coiler with their ring-shaped structure. This way optimal wire winding placement and thus an improved ring shape can be achieved.

According to a preferred embodiment of the invention, the downstream end of the feeder is formed as a split-roller assembly comprising spaced short rollers forming a continuation of the roller table of the feeder conveyor. This way, uniform and simultaneous displacement and positioning of all conveying sections downstream of the cooling unit is ensured. Furthermore, no gaps develop between the feeder conveyor and the split roller segment.

In accordance with the invention the feeder conveyor is oriented at an incline in the transport direction and is displaceable with its upstream end extending underneath a downstream end of the conveyor of the cooling unit, so that these two conveyors overlap. The resultant stepped transfer and the following inclined transport path improve the placement or feed conditions and allow operation at varying speeds.

The placement and transfer of the wire loops to the coiler is further improved in that the last conveying section of the cooling unit is likewise provided with pairs of split rollers disposed opposite each other at a transverse spacing.

According to one embodiment of the invention, the feeder conveyor is disposed on stationary guides, for example rails or similar running surfaces. So as to allow the feeder conveyor to be exactly positioned, it comprises at least one linear drive. The linear drive, whose stroke is controlled, may be hydraulic, mechanical or electromechanical adjusting means. For example, a toothed rack, gear combinations, ropes, chains, toothed belts, helical gears or the like may be used.

BRIEF DESCRIPTION OF THE DRAWING

The above and other objects, features, and advantages will become more readily apparent from the following description, reference being made to the accompanying drawing in which.

SPECIFIC DESCRIPTION

Figure 5:
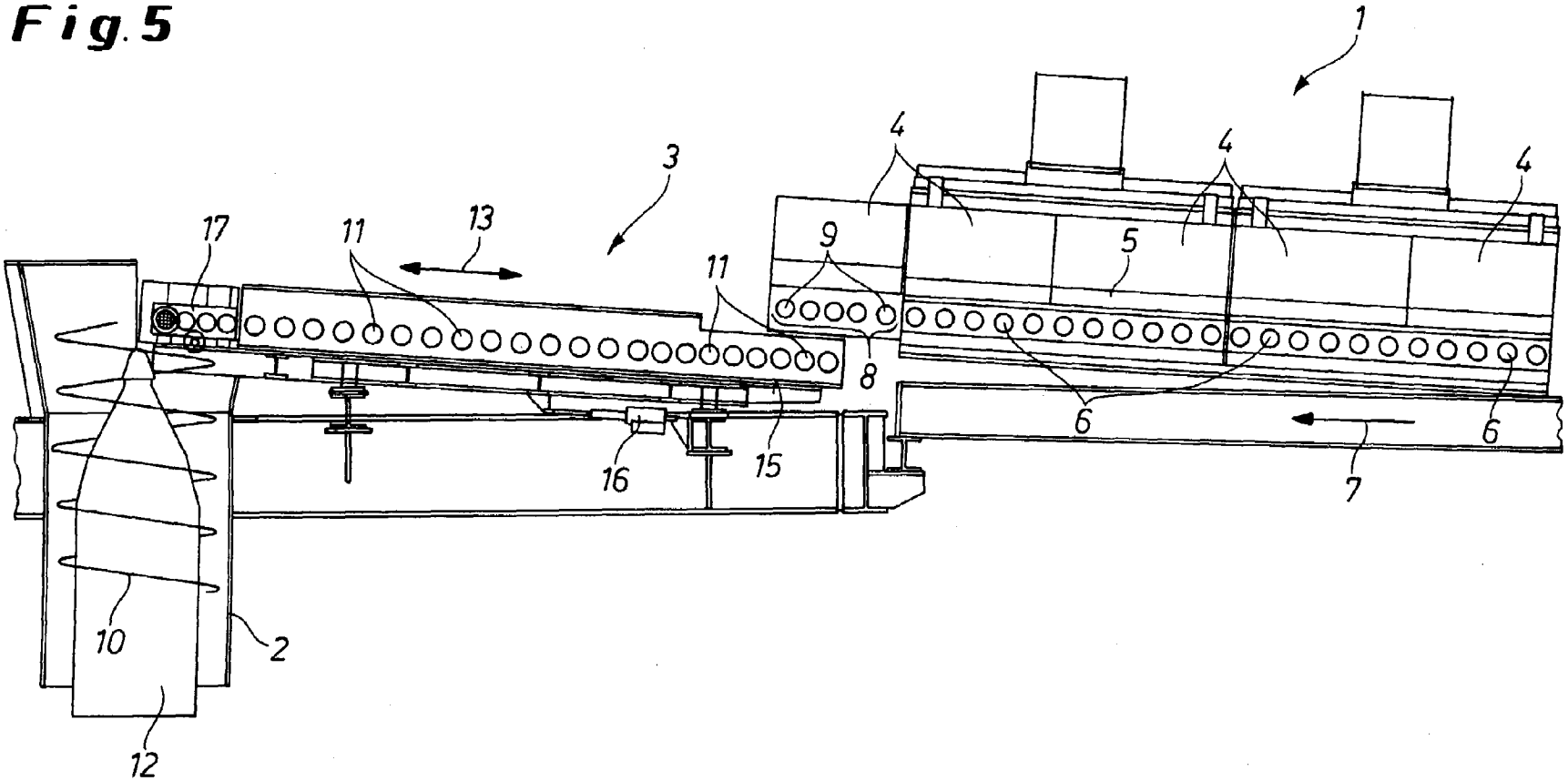
FIG. 5 is a side view of an embodiment with a feeder conveyor inclined at a small angle, a cooling unit, and a coiler disposed aligned in a transport direction.

As seen in FIG. 5 a system for rolling wire has a cooling unit 1 is disposed downstream of an unillustrated multistand wire-rolling mill, followed by a feeder conveyor 3 set up as a roller table functioning as a bridge to a coiler 2. The cooling unit 1 comprises several conveyors or roller tables 5 that are covered by hoods 4 or the like and comprise a plurality of table rollers 6 successively disposed in a carrying rack and rotatable about respective horizontal axes extending perpendicular to a transport direction 7. At least some of the rollers 5 are connected to drives 22 (see FIG. 3), and in the illustrated embodiment a furthest downstream roller table section 8 has split rollers 9, although these rollers 9 could be continuous, that is transversely throughgoing.

The wire that is rolled in the wire rolling mill comprising a plurality of stands is placed on the table rollers 6 by a laying head in the shape of spiral- or ring-shaped loops 10 (see FIG. 2) formed downstream of the furthest downstream roll stand and after having passed through a water bath, for example, and having been cut by a shear. From the cooling unit 1, the wire loops 10 are then transported further on table rollers 11, of which likewise some are driven, of the feeder conveyor 3. The loops are discharged from the downstream end of the feeder conveyor 3 into the chamber-like coiler 2, where a mandrel 12 (see FIG. 5) centers the wire loops to a finished coil.

Figure 3:
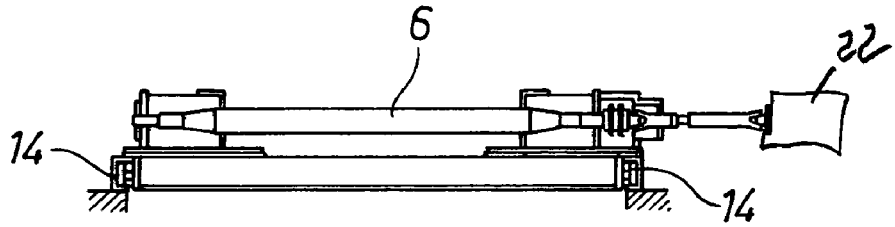
FIG. 3 shows the feeder conveyor according to FIGS. 1 and 2 in a cross-sectional view that illustrates in detailed form a table roller of a feeder conveyor configured as a table conveyor.

To allow the roller wire or the wire loops 10 to be transferred unimpaired and without gaps from the cooling unit 1 to the feeder conveyor 3 and from there into the coiler 2, the feeder conveyor 3 is entirely displaceable in the direction of the double arrow 13 (see FIGS. 1 and 5) parallel to the direction 7 on stationary guides 14 (see FIG. 3). Relative on the one hand to the downstream roller table section 8 of the cooling unit 1 and on the other hand to the coiler 2, the feeder conveyor 3 can thus be positioned by linear displacement exactly and with no space from the cooling unit 1.

Figure 4:
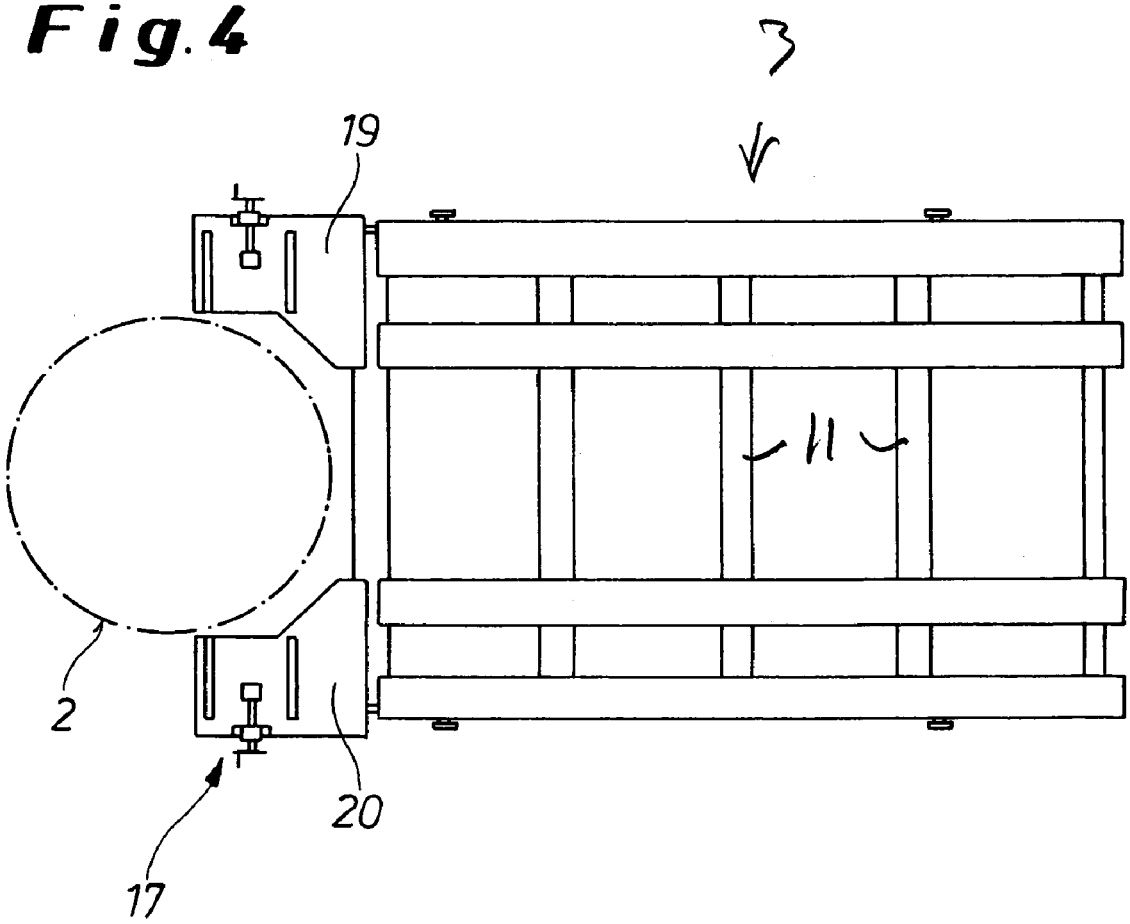
FIG. 4 shows the feeder conveyor in a schematic top view with the coiler provided.

FIG. 4 shows an embodiment in which the feeder conveyor 3 is configured with a slight incline at a small angle of inclination in the transport direction 7, similarly to the cooling unit 1, and has an upstream end section 15 reaching underneath the downstream roller table section 8 of the cooling unit 1.

Figure 1:
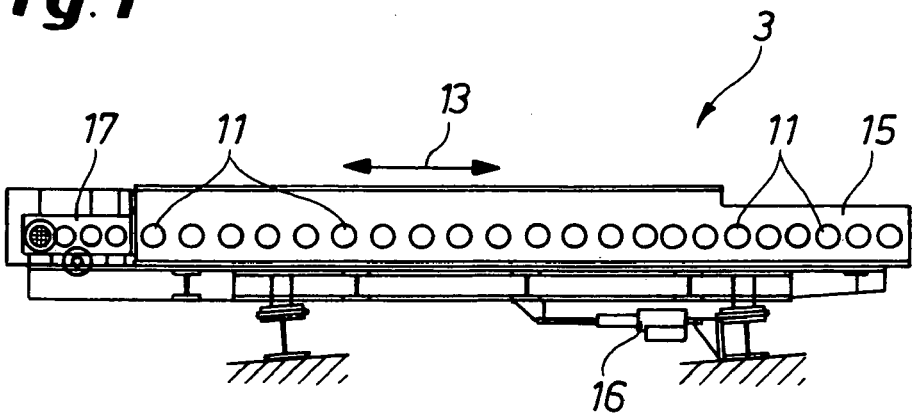
FIG. 1 shows a front view of a feeder conveyor as an individual unit of a known system for rolling wire.

As shown in FIGS. 1 and 5 at least one linear drive 18 is used for displacing the feeder conveyor 3. It can be provided in a variety of configurations, for example hydraulic, mechanical or electromechanical.

Figure 2:
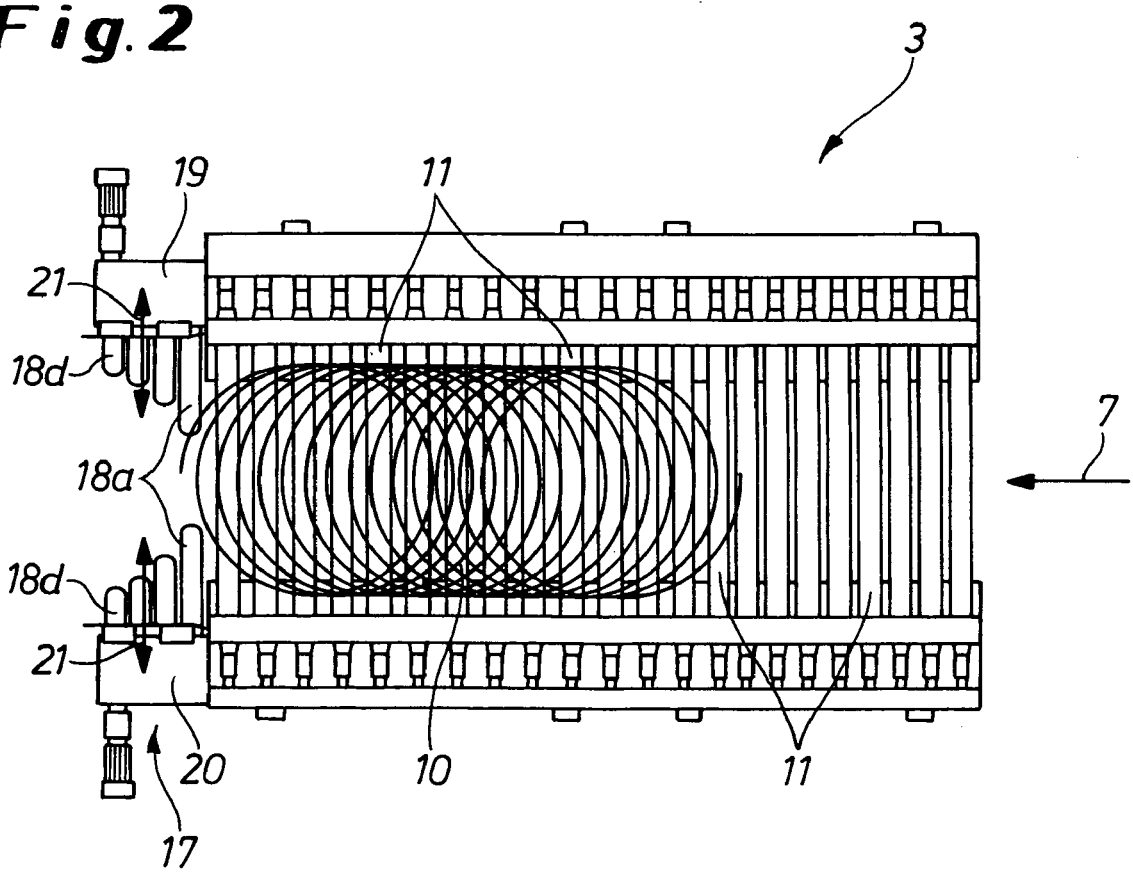
FIG. 2 shows the feeder conveyor according to FIG. 1 in top view.

As shown in FIGS. 2 and 4, on the downstream end of the feeder conveyor 3 in the removal region to the coiler 2 is formed as a split roller segment 17 that forms a smooth continuation of the feeder conveyor 3. The segment 17 comprises split rollers 18*a* to 18*d* arranged in pairs opposite each other, each split roller 18*a* to 18*d* of a roller pair being mounted in a separate roller segment half 19 or 20. The roller segment halves 19 or 20 are displaceable on the feeder conveyor 3 transversely to the transport direction 7, as indicated by the double arrow 21 (see FIG. 2).

The roller segment halves 19 or 20 are set for the size and shape of the coiler 2 and reach around it on both sides across part of the circumference to about its center plane, as shown in FIG. 4. FIG. 2 shows that the mutually opposed split rollers 18*a* to 18*d* become shorter in the transport direction 7 and hence toward the drop-off end where the loops 10 fall into the coiler 2. Thus the first upstream split rollers 18*a* are longer than the split rollers following in the transport direction 7, and the last split rollers 18*d* are the shortest.

We claim:

1. In combination a rolling-mill cooling unit having a cooling-unit conveyor transporting fanned-out loops of wire in a transport direction;

a coiler spaced downstream from the cooling-unit conveyor and serving to organize the fanned-out loops of wire into coils or bundles; and a feeder conveyor extending in the direction and having an upstream end juxtaposed with the cooling unit and a downstream end juxtaposed with the coiler and operable to advance the loops of wire from the unit to the coiler; and means for shifting the entire feeder conveyor relative to the coiler and the cooling unit in the direction and thereby displacing the upstream and downstream ends relative to the cooling unit and coiler.

2. The combination defined in claim 1 wherein the means for shifting includes guides extending in the direction and supporting the feeder conveyor; and an actuator braced between a fixed location and the feeder conveyor.

3. The combination defined in claim 1 wherein the feeder conveyor is shiftable both upstream and downstream in the direction.

4. The combination defined in claim 1 wherein the feeder conveyor defines a support plane angled upward from the upstream to the downstream end.

5. The combination defined in claim 4 wherein the upper end of the feeder conveyor extends upstream underneath a downstream end of the cooling-unit conveyor.

6. The combination defined in claim 1 wherein the cooling-unit conveyor has a downstream end formed by a plurality of short rollers arrayed in matched pairs spaced apart transverse to the direction.

7. The combination defined in claim 6 wherein the short rollers of each pair are of lengths that decrease downstream in the direction.

8. The combination defined in claim 1 wherein the feeder conveyor has a downstream end formed by a plurality of short rollers arrayed in matched pairs spaced apart transverse to the direction.

9. The combination defined in claim 8 wherein the short rollers of each pair are of lengths that decrease downstream in the direction.

10. The combination defined in claim 8 wherein the short rollers are shiftable transversely of the direction.

* * * * *